United States Patent [19]

Rankin

[11] 4,392,377

[45] Jul. 12, 1983

[54] EARLY GAS DETECTION SYSTEM FOR A DRILL STEM TEST

[75] Inventor: E. Edward Rankin, Fort Worth, Tex.

[73] Assignee: Gearhart Industries, Inc., Fort Worth, Tex.

[21] Appl. No.: 305,947

[22] Filed: Sep. 28, 1981

[51] Int. Cl.[3] ..... E21B 47/00

[52] U.S. Cl. ..... 73/155

[58] Field of Search ..... 73/155, 19; 250/269; 166/126, 128, 129, 131, 133, 332

[56] References Cited

U.S. PATENT DOCUMENTS

| | | | |
|---|---|---|---|
| 3,258,963 | 7/1966 | Bryant et al. | 73/155 |
| 4,083,401 | 4/1978 | Rankin | 166/250 |
| 4,094,359 | 6/1978 | King | 166/332 X |
| 4,108,243 | 8/1978 | King et al. | 166/332 X |

*Primary Examiner*—Jerry W. Myracle

*Attorney, Agent, or Firm*—James E. Bradley

[57] ABSTRACT

A method for testing earth formations informs the operator of the density of the formation fluid being produced before it reaches the surface. In the method, a bypass sub is secured to the drill string. The bypass sub has a bore for receiving a wireline tool that has sensing instruments. The wireline tool also has arms that will shift a sleeve to open and close the bypass sub. The wireline tool has a density measuring device for measuring the density of the formation fluid and providing a concurrent surface indication. A reversing valve is located above the bypass sub and is of a type that provides a port for reverse circulation while the wireline tool is still downhole. Preferably, the reversing valve is shifted by the wireline tool to the open position.

9 Claims, 5 Drawing Figures

EARLY GAS DETECTION SYSTEM FOR A DRILL STEM TEST

BACKGROUND OF THE INVENTION

This invention relates in general to apparatus and methods for testing earth formations, and more particularly to such apparatus and methods where a concurrent surface indication of an earth formation characteristic is provided during a drill stem test operation.

The method and apparatus of this invention is an improvement to the method and apparatus described in the following patents: U.S. Pat. No. 4,083,401, issued Apr. 11, 1978, E. Edward Rankin; U.S. Pat. No. 4,094,359, issued June 13, 1978, David W. King; and U.S. Pat. No. 4,108,243, issued Aug. 22, 1978, David W. King et al. In these patents, a method and apparatus for achieving concurrent surface indication of well characteristics is shown for drill stem testing and production tubing testing. In the drill stem testing operation, a packer is lowered in the well to a point a short distance above the formation to be tested. A bypass sub is mounted above the packer and connected to a drill string leading to the surface. The bypass sub has a bore that sealingly receives a wireline tool. A bypass passage extends around the bore to allow fluid to flow around the wireline tool while it is sealed in place.

In the operation, the wireline tool is lowered into the drill string and seated in the bore of the bypass sub. The bypass passage is selectively opened and closed by the wireline tool to allow fluid flow to the surface and also to allow a formation pressure buildup. The wireline tool has temperature and pressure gages which provide concurrent surface indication through the wireline to instruments located at the surface.

After the testing is completed, the wireline tool is withdrawn to the surface. Then a ball is pumped down the drill stem to a valve located above the bypass sub. The ball, under pressure, shears the valve to allow fluid from the well annulus to flow into the drill pipe. Pumps at the surface reverse circulate fluid from the well annulus up the drill pipe to remove the formation fluid from the drill pipe before removing the drill string.

While this method is satisfactory, in certain wells an unexpected amount of gas may be present. The gas will flow to the surface and through testing equipment where the flow rate and pressure is measured at the surface. The gas then must be flared off. A large quantity of gas may exceed the capabilities of the testing equipment, resulting in the burners being melted. The wireline instrument in the above mentioned patents does not have the capability of informing the operator that a large amount of gas is present in the formation.

Another disadvantage in the method taught in the above-mentioned patents is that the wireline tool must be completely withdrawn from the well before the well is killed by reverse circulating. At times, particularly if a large amount of gas or pressure is present in the drill stem, it would be preferable to kill the well before removing the wireline, since removing the wireline may take up to about an hour and must rely on pressure sealing equipment that seals against a moving wireline.

SUMMARY OF THE INVENTION

In this invention, the system utilizes a bypass sub that is mounted above the packer and has a bore for sealingly receiving a wireline instrument. A bypass passage will allow formation fluid to flow around the wireline tool while it is sealed in place. The wireline tool and the bypass sub have means for selectively opening and closing the passage. The wireline tool, in addition to pressure and temperature measuring equipment, has an instrument that will detect the density of the formation fluid being produced. This gives the operator an indication of the amount of gas that will be present. If it appears that an excessive amount of gas will be present, the flow can be cut off before a large amount of gas proceeds up the drill string.

Also, the system has a reversing valve located above the bypass sub that selectively opens and closes a port leading from the interior of the drill string to the well annulus. This valve is actuable by the wireline instrument. Reverse circulation can be achieved while the wireline remains in place at the valve. After the well is killed, the wireline instrument can be safely removed from the drill string.

DESCRIPTION OF THE PREFERRED EMBODIMENT

Figure 1:
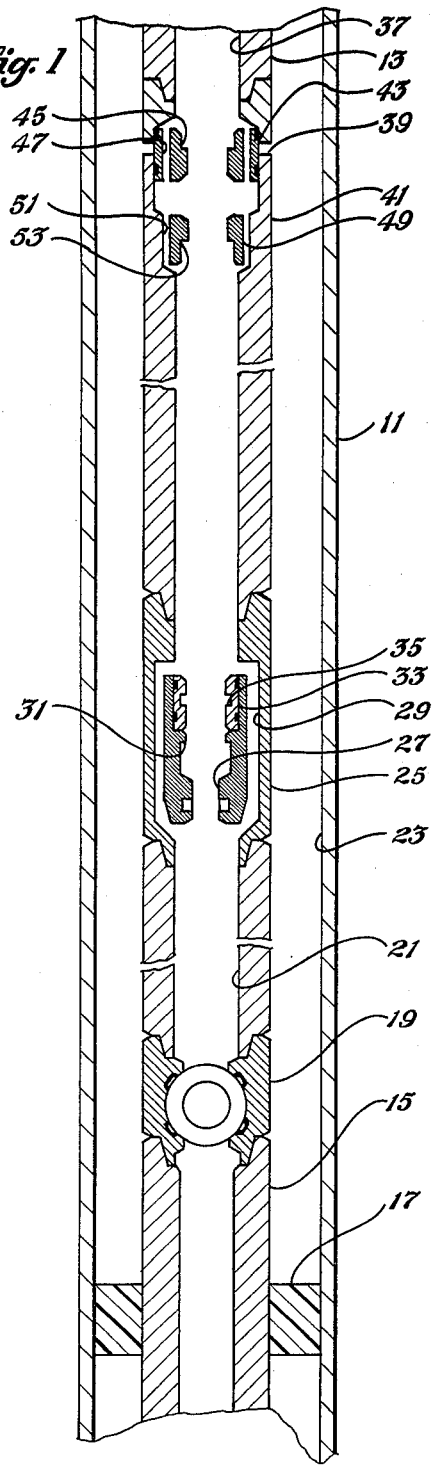
FIG. 1 is a vertical sectional view of the equipment of this invention that is secured to the drill string.

Referring to FIG. 1, well casing 11 will normally be cemented within the well, although this system also will work with open hole tests, not having casing. A drill string 13, made up of sections of drill pipe, is lowered into the well. The equipment connected to the bottom of the drill string 13 includes a conventional drill string test assembly 15 having a packer 17, as shown schematically. The drill stem test assembly 15 also includes a valve 19 that will open selectively the passage 21 extending through the test assembly 15. In the embodiment shown, valve 19 is of a type that opens in response to pressurized fluid in the annulus 23 surrounding the test assembly 15. Packer 17 is preferably a type that is set by rotating the drill string 13 in one direction.

A bypass sub 25 is mounted above test assembly 15. Bypass sub 25 is shown schematically and is of the same type as shown in U.S. Pat. Nos. 4,083,401; 4,094,359; and 4,108,243, all of which material is hereby incorporated by reference. Bypass sub 25 has an inner sealing bore 27. A bypass passage 29, shown to be annular in this embodiment, extends around the bore 27. An annular downwardly facing shoulder 31 is located in bore 27. An annular sliding valve 33 is located at the upper end of bore 27. Valve 33 selectively opens and closes the upper end of the bypass passage 29. An annular groove 35 is located in valve 33.

A reversing valve means for communicating well annulus 23 with the interior passage 37 of drill string 13 is mounted above bypass sub 25 and is shown schematically. This valve means includes a port 39 that extends through a reversing sub 41, the sub 41 being normally about 90 feet above bypass sub 25. An annular sliding sleeve 43 selectively opens and closes port 39. Sleeve 43 has an upwardly facing shoulder 45 on its inner bore. A plurality of longitudinal passages 47 are located in sleeve 43 to provide a total cross-sectional passage dimension, including the internal bore, equal to the cross-sectional area of drill stem pipe passage 37.

A stationary latching member 49 is located below sleeve 43. Latching member 49 is rigidly mounted to bypass sub 41 and has longitudinal passages 51 spaced around its periphery for providing a total cross-sectional area, including its bore, equal to the cross-sectional area of drill stem passage 37. A downwardly facing shoulder 53 is located in the bore of latching member 49.

The drill string 13 will also normally include as redundant safety means one or more annular pressure reversing subs (not shown) in the drill string above the bypass sub 25. The annular pressure reversing subs are of a conventional type that open to communicate the well annulus 23 with the drill string passage 37 under hydraulic pressure applied to the annulus 23. The hydraulic pressure necessary to open the annular pressure reversing sub will be greater than the hydraulic pressure needed to open the valve 19.

Figure 2:
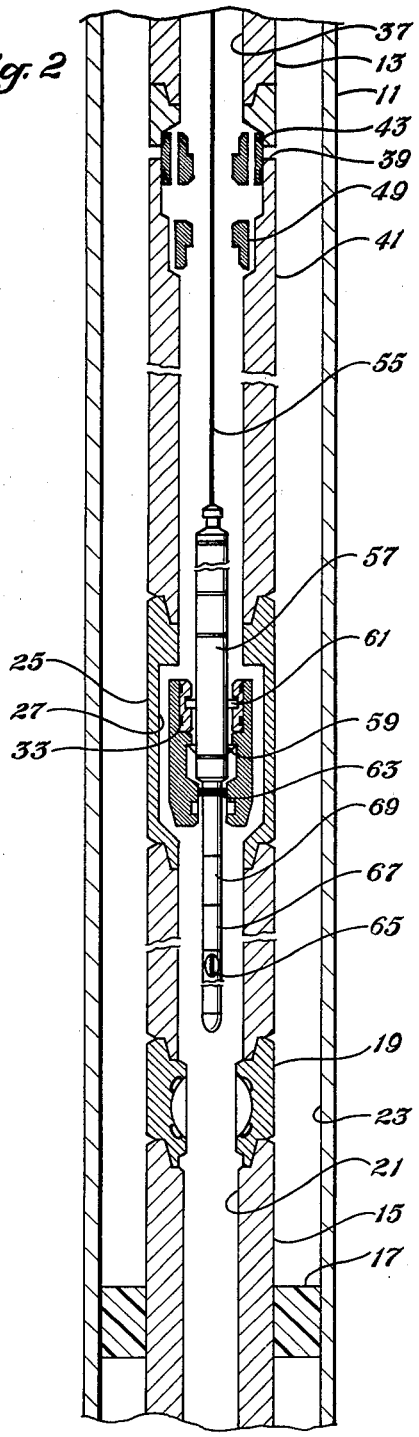
FIG. 2 is a view of the equipment of FIG. 1, and also showing the wireline instrument in place and with the bypass passage open.

Referring to FIG. 2, the wireline equipment includes a conductor cable 55 that is lowered from a drum on the surface. An electrical shifting tool 57 is connected to the wireline. Electric shifting tool 57 is the same type as shown in U.S. Pat. Nos. 4,083,401; 4,094,359; and 4,108,243. The shifting tool has lower dogs 59 that can be actuated to move between a retracted position and an open position to engage shoulder 31. The open position prevents upward movement of the shifting tool 57. Upper dogs or arms 61 are actuable between a retracted position and an open position to engage groove 35 in sleeve 33. Arms 61 will then move the sleeve between the open position shown in FIG. 2 to the closed position shown in FIG. 3. Actuation of dogs 59 and arms 61 is performed by an electrical motor controlled from the surface through cable 57.

Sensing instruments are mounted below shifing tool 57 and sealed within bore 27 by a seal section 63. The sensing instruments include a depth indicating instrument 65, a temperature and pressure gaging instrument 67, and a density measuring instrument 69. All of these instruments are conventional, and need not be assembled in the particular order indicated. The density instrument uses radioactivity to measure the density of the fluid that it is contained within. The temperature and pressure instrument measures the temperature and pressure of the fluid that it is contained within. The depth indicating instrument provides an indication of the surface of a structure located within the well, using magnetic signals, to assure that the instrument is located in the proper position.

In operation, drill string 13 will be lowered within the well casing 11 with packer 17 in a closed position (not shown). Once located a short distance above the formation for testing, packer 17 will be actuated by rotating drill string 13. This seals the annulus fluid contained in annulus 23 from the formation fluid. While running in, valve 19 will be closed as shown in FIG. 1. Passage 37 of the drill string 13 may contain water, in the case of a high pressure well, or if low pressure is expected, it may be substantially dry except for a short column of protective fluid extending above bypass sub 25. The protective fluid protects the bypass sub from damage in case foreign materials are accidentally dropped into the passage 37 while running in.

The shifting tool 57, with its instruments, is then lowered into the well on cable 55. When seal section 63 reaches bore 27, the tool will be prevented from dropping any further in the drill string because of the smaller dimension of the bore 27 than the housing of shifting tool 57. Once in place, the lower dogs 59 are actuated to latch the shifting tool 57. Then the upper arms 61 are extended out to engage the sleeve 33. Normally sleeve 33 will then be moved to the closed position. When in this position, shown in FIG. 3, the annulus fluid in annulus 23 is pressurized to open valve 19. Pressure must be maintained in annulus 23 to keep valve 19 open, otherwise it will spring to the closed position shown in FIG. 1. Formation fluid will flow up passage 21, and into the bypass passage 29 where it stops. The pressure of the fluid will be sensed at the surface.

Then arms 61 are moved down to allow flow through bypass passage 29 and drill pipe passage 37 to the surface, as shown in FIG. 2. As it flows, the temperature and pressure will be sensed by the temperature and pressure tool 67, and a concurrent reading will be transmitted through cable 55 to the surface. At the same time, density tool 69 will serve as sensing means to sense the density and provide a concurrent surface indication to the surface.

Figure 3:
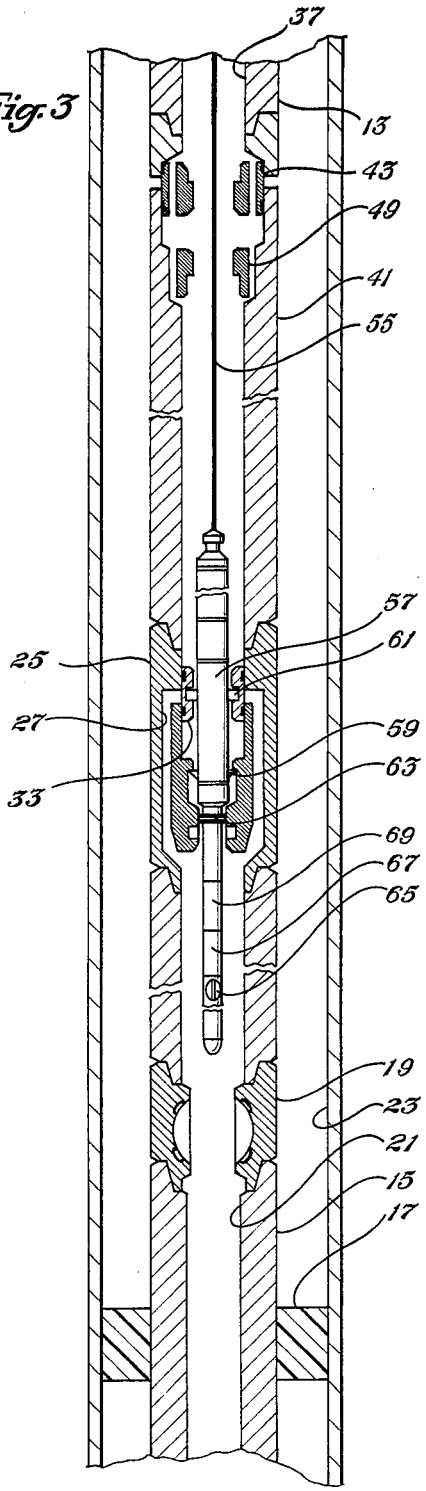
FIG. 3 is a view of the equipment shown in FIG. 2, but with the bypass passage closed.

Under normal conditions, the well would be allowed to flow for the length of time that the operator feels it is necessary to adequately test the well after sufficient flow. After sufficient flow, arms 61 are actuated to slide sleeve 33 upwardly to close off bypass passage 29, as shown in FIG. 3. The formation pressure will then gradually build up to its maximum amount. The temperature, pressure, and density will be concurrently indicated at the surface.

Figure 4:
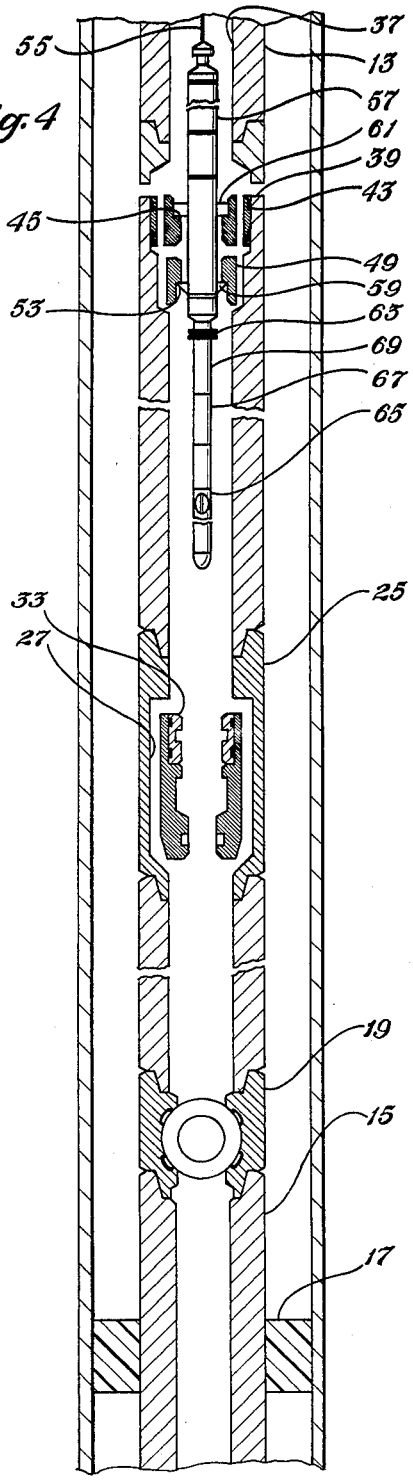
FIG. 4 is a view of the equipment of FIG. 2, but with the annulus valve open.
Figure 5:
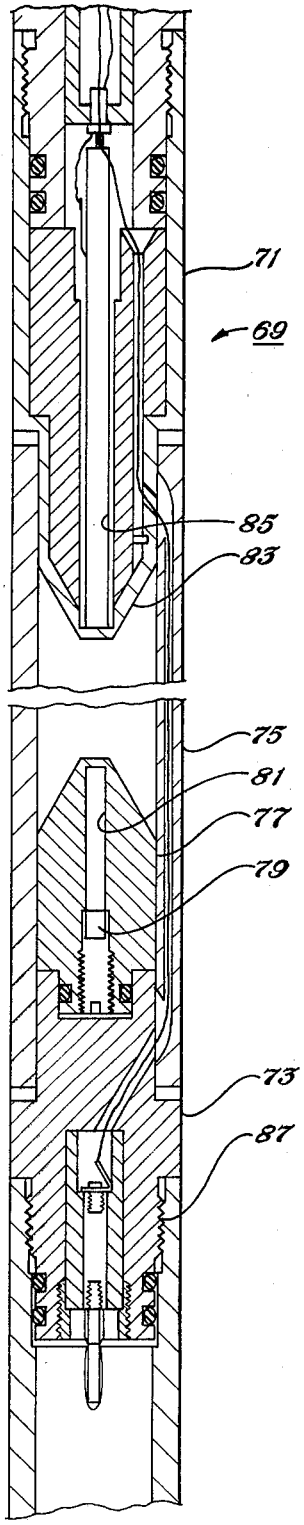
FIG. 5 is a vertical sectional view of a tool for measuring the density of well fluid and used with the wireline instrument of this invention.

When it is apparent that the pressure has levelled off at a maximum amount, the test will be completed. Pressure will be relieved on annulus 23 to close valve 19, as shown in FIG. 4. Upper arms 61 will be actuated to slide sleeve 33 back to the open position and retract. Lower dogs 59 will retract. Pressure can then be bled off from the drill string.

The instrument will then be pulled up to the reversing sub 41 and actuated to open the reversing valve means. The shifting tool 57 is pulled up below reversing sub 41 with dogs 59 open to securely engage shoulder 53. Upper arms 61 are then extended out and moved upward to a point above sleeve shoulder 45. Arms 61 are then brought downwardly to engage the sleeve shoulder 45 and push the sleeve 43 downward. This position, as shown in FIG. 4, opens the port 39. Annulus fluid, such as drilling mud, is then pumped down the annulus 23, through ports 39 and up the drill string passage 37. This removes the formation fluid from the drill string and fills the drill string with formation fluid.

Then, the lower dogs 59 and the upper arms 61 are retracted and the shifting tool 51 is brought to the surface. The packer 17 is released and the drill string 13 with its downhole test assembly 15 can be brought to the surface. The packer 17 can be released either before or after the shifting tool 57 is brought to the surface normally by pulling upward on the drill string 13. The drill string 13 and packer assembly 15 are then removed from the well.

Referring again to FIG. 2, if during the initial few minutes of the flowing test, the density tool 65 indicates that an extensive amount of gas under high pressure is located in the formation, precautions can be taken to prevent too much gas from flowing to the surface, where it will be difficult and dangerous to dispose. Once the density and pressure tools indicate this large amount of gas, the pressure can be relieved on the annulus 23 to cause valve 19 to close, shutting off the flow of gas up the drill string. After bleeding off the gas in the drill string, the shifting tool 57 then is brought up to the reversing sub 41. It opens sleeve 43 in the same manner as previously described to circulate the formation fluid from the drill string 13 and fill the drill string with heavier annulus fluid.

FIG. 3 discloses part of the structure of a suitable density tool 69, these types of tools being conventional. Density tool 69 includes an upper housing 71 carried by the shifting tool 57 (FIG. 1). Upper housing 71 is connected to a lower housing 73 by means of three, spaced-apart longitudinal rods 75.

A source collimator 77 is mounted to lower housing 73. Source collimator 77 contains a radioactive source 79 located at the base of an axial passage 81. Source 79 is preferably Cesiun 137, 17 millicuries. Passage 81 is closed at the top and focuses upward gamma rays emitted by the source 79. A detector collimator 83 is spaced above the source collimator 77 a selected distance. Detector collimator 83 includes a Geiger-Mueller detector 85 that is axial and aligned with passage 81 for receiving and detecting the gamma rays beamed from source 79. Associated circuitry (not shown) provides to the surface an indication of gamma rays counted. An electrical adaptor pin assembly 87 on the bottom of housing 73 provides means for electrical connection with any tools located below the density tool 69, such as the temperature and pressure instrument 67.

In the operation of the density tool, source 79 emits gamma rays, which proceed through formation fluid that the tool 69 is immersed in, since the rod 75 allow the formation fluid to flow between the source collimator 77 and the detector collimator 83. The detector collimator 83 detects the gamma rays that are able to pass through the formation fluid. Higher numbers of gamma rays counted indicates a lower fluid density. A correlation is made at the surface to indicate fluid density. The fluid density, coupled with the pressure being measured, indicates the gas flow rate.

The invention has significant advantages. Providing a density tool with the shifting tool allows a concurrent surface indication of gas, enabling the operator to stop the flow of gas before too much enters the drill pipe. The reverse circulation valve that allows circulation while the wireline tool is still downhole enables the well to be killed much quicker and safer than in the prior art teaching, which required bringing the wireline tool out of the well before reverse circulating.

While the invention has been shown in only one of its forms, it should be apparent to those skilled in the art that it is not so limited but is susceptible to various changes and modifications without departing from the spirit of the invention.

I claim:

1. In a method for providing concurrent surface indication of earth formation characteristics during drill stem testing, the method including the steps of running in on a drill string a releasable packer and a bypass sub having a bore for sealingly receiving a wireline tool and a bypass passage means permitting formation fluid flow around the wireline tool, then selectively opening and closing the bypass passage means with the wireline tool sealed in the bore and the packer set to selectively shut in and allow formation fluid flow to the surface while concurrently providing to the surface through the wireline formation flowing and shut in characteristics sensed by the wireline tool, the improvement comprising:

providing for the wireline tool, sensing means for sensing the gas content of the formation fluid and providing a concurrent indication to the surface;

providing a reversing valve means for communicating a well annulus with the interior of the drill string while the wireline instrument is located downhole;

stopping the flow of formation fluid should the sensing means indicate the possibility of a gas flow rate above a selected safe minimum; then reversing circulating annulus fluid from the annulus down through the reversing valve means and up the drill string to remove formation fluid from the drill string; then removing the wireline tool.

2. The method according to claim 1 wherein the reversing valve means is actuable by the wireline tool.

3. The method according to claim 1 wherein the reversing valve means is shifted to an open position by extending from the wireline tool a lower dog to engage a stationary portion of the reversing valve means, and extending from the wireline tool an arm which engages a sliding sleeve of the reversing valve means; then sliding the sleeve by moving the arm.

4. The method according to claim 1 wherein the sensing means senses the density of the formation fluid.

5. The method according to claim 1 wherein the flow of formation fluid is stopped at the conclusion of the test by closing a valve located below the bypass sub, the valve being closed by releasing pressure on the annulus.

6. In a method for providing concurrent surface indication of earth formation characteristics during drill stem testing, the method including the steps of running in on a drill string a releasable packer and a bypass sub having a bore for sealingly receiving a wireline tool and a bypass passage means for preventing formation fluid flow around the wireline tool, then selectively opening and closing the bypass passage means with the wireline tool sealed in the bore and the packer set to selectively shut in and allow formation fluid to flow to the surface while concurrently providing to the surface through the wireline formation flowing and shut in characteristics sensed by the wireline tool, the improvement comprising;

providing a reversing valve means above the bypass passage means that is actuable by the wireline tool for communicating a well annulus with the interior of the drill string;

withdrawing the wireline tool from engagement with the bypass means and opening the reversing valve means with the wireline tool, when testing is completed; then reverse circulating annulus fluid from the wall annulus through the reversing valve means and up the interior of the drill string.

7. The method according to claim 6 wherein the wireline tool remains in engagement with the reversing valve means during reverse circulation and is brought to the surface after reverse circulation is completed.

8. In a method for providing concurrent surface indication of earth formation characteristics during drill stem testing, the method including the steps of running in on a drill string a releasable packer and a bypass sub having a bore for sealingly receiving a wireline tool and a bypass passage means for preventing formation fluid flow around the wireline tool, then selectively opening and closing the bypass passage means with the wireline tool sealed in the bore and the packer set to selectively shut in and allow formation fluid to flow to the surface while concurrently providing to the surface through the wireline formation flowing and shut in characteristics sensed by the wireline tool, the improvement comprising;

providing the wireline tool with density means for sensing the density of the formation fluid and providing a concurrent indication to the surface;

providing a reversing valve means above the bypass passage means that is actuable by the wireline tool for communicating a well annulus with the interior of the drill string;

withdrawing the wireline tool from engagement with the bypass passage means and opening the reversing valve means with the wireline tool should the density means indicate the possibility of a gas flow rate above a selected safe minimum, the valve means being opened by extending a dog from the wireline tool into engagement with a stationary portion of the reversing valve means, and extending an arm from the wireline tool for engaging a sliding sleeve of the reversing valve means, then moving the arm to slide the sleeve;

reverse circulating annulus fluid from the annulus through the reversing valve means and up the drill string while maintaining the dog in engagement with the reversing valve means; then disengaging the arm and dog from the reversing valve means and withdrawing the wireline tool to the surface.

9. The method according to claim 8 wherein the sleeve of the reversing valve means is opened by downward sliding movement caused by the arm.

* * * * *